United States Patent [19]

Matsushita et al.

[11] Patent Number: 4,644,331

[45] Date of Patent: Feb. 17, 1987

[54] FIRE ALARM SYSTEM

[75] Inventors: Eige Matsushita, Kanagawa; Tetsuya Nagashima, Tokyo, both of Japan

[73] Assignee: Hochiki Corporation, Tokyo, Japan

[21] Appl. No.: 746,116

[22] Filed: Jun. 18, 1985

[30] Foreign Application Priority Data

Jun. 29, 1984 [JP] Japan ..... 59-134830

[51] Int. Cl.[4] ..... G08B 17/06

[52] U.S. Cl. ..... 340/587; 340/584; 340/588; 340/628

[58] Field of Search ..... 340/587, 588, 577, 584, 340/628; 364/178, 551, 723, 734

[56] References Cited

U.S. PATENT DOCUMENTS 4,195,286 3/1980 Galvin ..... 340/587

4,469,944 9/1984 Kern et al. ..... 340/587

4,568,924 2/1986 Wüthrich et al. ..... 340/587

*Primary Examiner*—Glen R. Susann, III

*Attorney, Agent, or Firm*—Wenderoth, Lind & Ponack

[57] ABSTRACT

The detection signals regarding the temperature or smoke concentration generated due to the fire are sampled. The sampled data is processed by being averaged. An occurrence of a fire is determined on the basis of the processed data, i.e. - the averaged data, after completion of the averaging processes. The detection signals which are used for the fire determined are obtained by performing a moving mean calculation of a plurality of sampled data as one group and/or by executing a simple mean calculation of a plurality of moving mean data as one group.

6 Claims, 6 Drawing Figures

FIRE ALARM SYSTEM

BACKGROUND OF THE INVENTION

The present invention relates to a fire alarm system which processes an analog detection signal regarding smoke, temperature or the like and thereby warns of a fire on the basis of the processed data.

In conventional fire alarm systems, in general, a change in a single physical phenomenon such as smoke, heat or the like which is caused by the occurrence of fire is detected by a fire sensor, and when the detection value exceeds a preset threshold level, a fire signal is sent to the receiver and thereby warns of a fire.

However, in the case where the presence of a fire is determined by simply checking whether or not the detection value exceeds the threshold level, the occurrence of a fire is falsely determined when the detection value is over the threshold level due to causes other than a fire, for example, due to temporary noise or the like, so that a problem is caused because a spurious alarm is outputted.

On one hand, in the case of detecting smoke due to a fire, the quantity of smoke which is generated at the initial state of the actual fire is always changing with an elapsing of time due to the enlargement of the fire, an oscillating frequency which is peculiar to the flame or the like. The detection value of the smoke which is detected by the smoke detecting section of the smoke sensor also varies depending on the shape of the room or the like as well as the above-mentioned various factors. Therefore, the smoke detection value includes a number of other undesirable harmonic components in addition to the necessary inherent fundamental frequency of the smoke and is outputted from the smoke detecting section of the smoke sensor. Consequently, if the fire is determined using the detection value from the smoke sensor as is, there is a risk that a comparison is made between the threshold level and an improper detection value which deviates quite far from the inherent fundamental component of the smoke.

Since the detection value is incorrect as described above, there is a problem in that the prediction determination accuracy is deteriorated if such a conventional smoke detecting method is applied to an apparatus which is constituted in such a manner that: an analog detection signal regarding, for instance, smoke, temperature or the like which can be always obtained is sampled and converted to a number of digital data; the time interval from a point in time until the value of the detection signal becomes the threshold level is calculated using a plurality of digital data as they are by way of a differential value calculating method or a function approximation method; and the fire is predicted by checking whether or not this time interval lies within a predetermined time period.

SUMMARY OF THE INVENTION

The present invention is made in consideration of the above-mentioned problems and it is an object of the invention to provide a fire alarm system which can accurately determine that a fire has occured even when signal components other than the inherent detection component such as the smoke concentration, temperature or the like are included in the detection signal regarding the smoke, temperature or the like which is outputted from the detecting section.

Another object of the invention is to provide a fire alarm system in which after the detection signal regarding smoke, temperature or the like which is outputted from the detecting section of the sensor was sampled during every constant period and was converted to digital data, the moving mean of a plurality of detection signals is calculated and the influence of the unnecessary signal components is thereby eliminated.

Still another object of the invention is to provide a fire alarm system which performs the averaging process in such a manner as to calculate the moving mean of a plurality of detection signals as one group and further to obtain the simple mean of a plurality of moving mean values as one group.

The above and other objects, features and advantages of the present invention will be more apparent from the following detailed description in conjunction with the accompanying drawings.

DETAILED DESCRIPTION OF THE PREFERRED EMBODIMENTS

Figure 1:
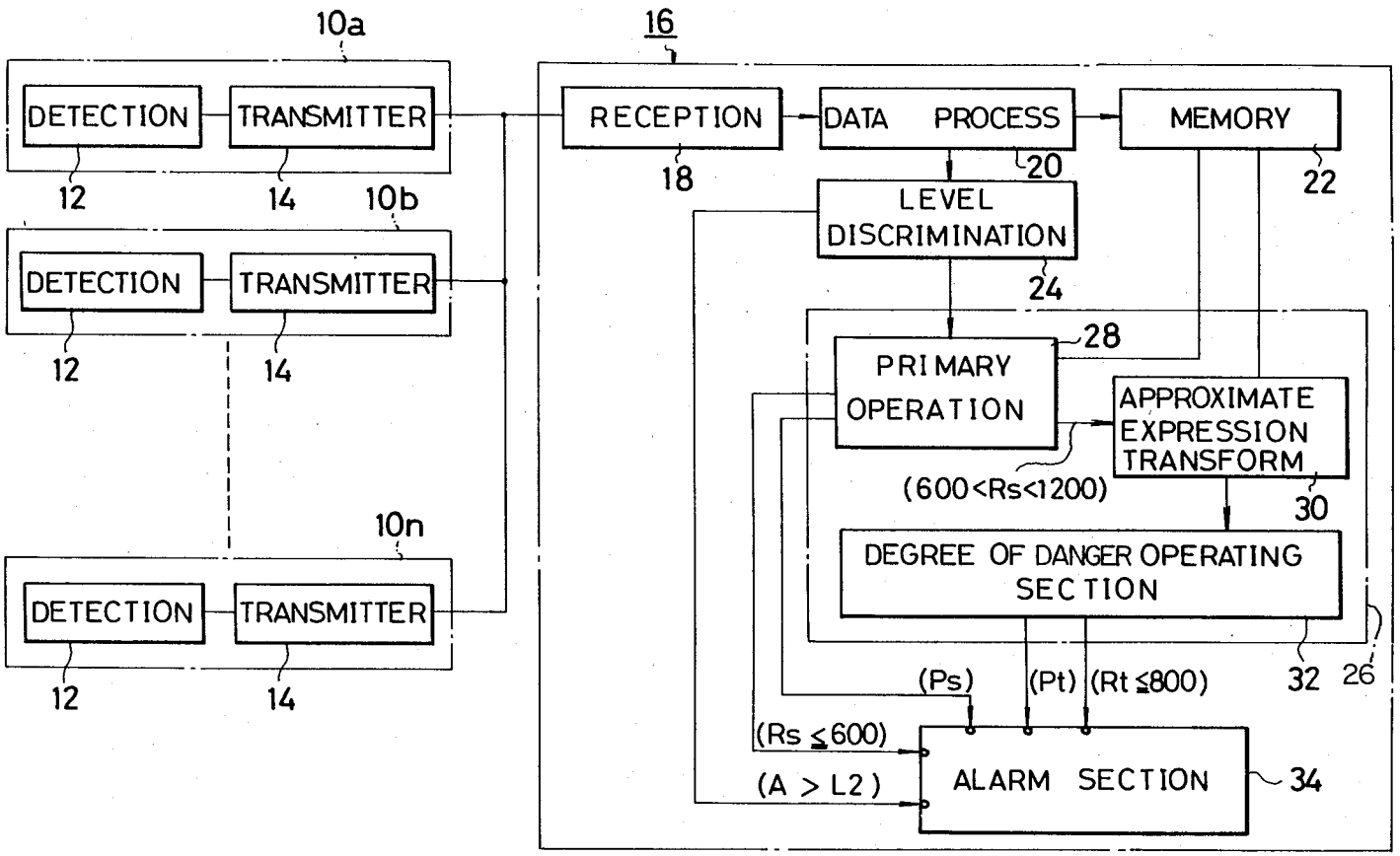
FIG. 1 is a block diagram showing an embodiment of the present invention.

In FIG. 1, reference numerals 10*a*, 10*b*, . . . , 10*n* denote analog sensors each for detecting in an analog manner a change in a physical phenomenon of the ambient circumstances due to the occurrence of fire, and addresses are respectively preset for these sensors. Each of the analog sensors 10*a* to 10*n* includes therein a detecting section 12 to detect a temperature, a gas concentration, a smoke concentration, or the like and a transmitter 14 to transmit a detection signal detected by the detecting section 12. A receiver 16 is provided with a microcomputer and processes the detection signals from the analog sensors 10*a* to 10*n*, thereby predicting and determining a fire on the basis of the predicting operation. In the receiver 16, a reception section 18 includes an A/D converter therein and collects the detection signals from the sensors 10*a* to 10*n* during every predetermined time interval of t seconds by way of a polling method. The reception section 18 then A/D converts the detection signals and outputs the digital signals to a data processing section 20. The data processing section 20 classifies the A/D converted detection signals from the receiving section 18 for analog sensors 10*a* to 10*n* and then performs averaging processes to obtain the moving mean and simple mean with respect to each detection signal. Practically speaking, a plurality of detection signals from each of the analog sensors 10*a* to 10*n* are processed as one group. Namely, whenever a predetermined number, for example, three of those detection signals are obtained, the moving mean value is calculated. Furthermore, a plurality of these moving mean values are processed as one group for analog sensors 10*a* to 10*n*. Whenever a predetermined number, for example, six of those moving mean values are derived, the simple mean value is calculated. These values are outputted as processing data to a memory section 22 and a level discriminating section 24. A predetermined number, for instance, twenty of processed data of each analog sensor are classified for every address of the analog sensors 10*a* to 10*n* and are stored in the memory section 22. Whenever the processing data is obtained from the data processing section 20, the memory section 22 sequentially updates the memory content and stores the data. Threshold values of a fire level $L_2$ and of an operation start level $L_1$ whose value is lower than the fire level $L_2$ are preliminarily set in the level determines that section 24. The section 24 discriminates a fire has occurred in the case where a sudden change in circumstances occurs and also determines the start of the predicting calculation. In other words, when the value of the processed data A from the data processing section 20 becomes $L_2$ or more ($A \geqq L_2$), the level discriminating section 24 determines that there is a sudden change in circumstances due to a fire and outputs a fire signal to an alarm section 34. On one hand, when the value of the processed data A lies within a range of $L_1 \leqq A < L_2$, the level discriminating section 24 designates the address of the analog sensor corresponding to the processed data whose value exceeds the threshold value $L_1$ and then generates a command to start the predicting calculation to a primary operating section 28. Furthermore, in the case where $A < L_1$, the discriminating section 24 determines that the room condition is normal and stops outputting the signal to the primary operating section 28, thereby inhibiting the predicting calculation.

An operating section 26 takes out the processed data of the analog sensor of the address designated by the level discriminating section 24 from the memory section 22 and then performs the predicting calculation on the basis of this processed data by way of a differential value calculating method or a function approximation method. The primary operating section 28 is made operative in response to the command from the level discriminating section 24 and converts a plurality of processed data to a linear function equation by way of the differential value calculating method and then performs the predicting calculation on the basis of this equation. First, the gradient of the linear function equation is determined as the first predicting calculation. In the case where a fire is predicted as the result of this gradient, the primary operating section 28 outputs a prealarm $P_s$ to the alarm section 34 and further executes the second predicting calculation. That is, a dangerous level $L_3$ whose value is higher than the fire level $L_2$ is preset and the time interval until the value of the processing data becomes the dangerous level $L_3$ is calculated as a degree of danger from the processed data at the present time and the linear function equation.

Assuming that a degree of danger due to the differential value calculating method as $R_s$ (whose units are in seconds), when the value of the degree of danger $R_s$ is, for example, $$R_s \leqq 600$$

as the result of the second predicting calculation, the primary operating section 28 determines the occurrence of fire and outputs the fire signal to the alarm section 34. On one hand, when the value of the dangerous degree $R_s$ lies within a range of, for example, $$600 < R_s \leqq 1200,$$

an uncertain signal is outputted to an approximate expression transforming section 30 and the start of the predicting calculation by way of the function approximation method is commanded. When $$R_s > 1200,$$

for instance, the room condition is determined to by normal, so that the signal outputting to the approximate expression transforming section 30 is stopped, thereby inhibiting the predicting calculation by way of the function approximation method. The transforming section 30 takes out all of the processing data stored in the memory section 22 in response to the uncertain signal from the primary operating section 28 and then converts these data to a quadratic or higher-order function equation on the basis of this processed data due to the function approximation method. Thus, it is possible to obtain the equation which is more accurate than the linear function equation and by which the output tendency of the detecting signals from the analog sensors can be more apparently understood. A degree of danger operating section 32 calculates the time interval (degree of danger) from the present time until the detecting signal becomes the dangerous level $L_3$ on the basis of the approximate equation which is the quadratic or higher-order function equation from the transforming section 30. Assuming that a degree of danger calculated on the basis of the approximate equation due to this function approximation method is $R_t$ (whose units are in seconds), when the value of the degree of danger $R_t$ is, for example, $$R_t \leqq 800,$$

the operating section 32 determines the occurrence of fire and outputs a fire signal to the alarm section 34. In addition, the approximate curve by way of the approximate equation is analyzed and the gradient after an expiration of 800 seconds from the present time is determined. In the case where the gradient is positive, a prealarm $P_t$ is outputted to the alarm section 34 from the operating section 32.

Figure 2:
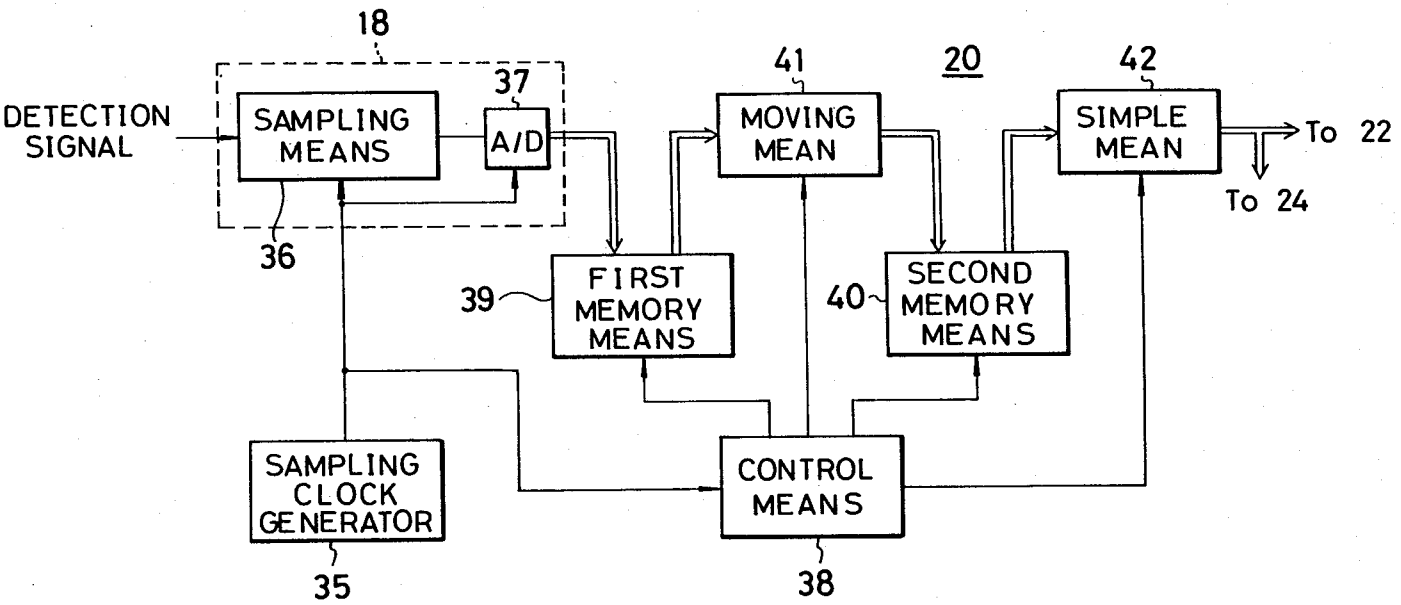
FIG. 2 is a block diagram showing an embodiment of a receiving section and a data processing section in FIG. 1.

FIG. 2 is a block diagram showing an embodiment of the receiving section 18 and data processing section 20 in FIG. 1.

In FIG. 2, sampling means 36 is driven in response to a clock signal from a sampling clock generator 35 and takes in the detection signal from the analog sensor 10. The detection signal sampled by the sampling means 36 is sequentially converted to the digital data by an A/D converter 37 in response to the clock signal from the sampling clock generator 35.

Control means 38 receives the clock signal of the generator 35 and transmits a rewrite command signal of the detection signal to first and second memory means 39 and 40, thereby instructing the start of the operations to means 41 for obtaining the moving mean and means 42 for deriving the simple mean.

The first memory means 39 classifies the digital signals from the A/D converter 37 into the detection signal for every analog sensor 10 and at the same time stores at least as many of the present and past detection signals as the number of signals which are used to derive the moving mean. For example, in case of calculating the moving mean by use of three detection signals, at least the present detection signal and the detection signals of one and two prior sampling periods are stored. Furthermore, the first memory means 39 erases the old detection signals one by one in response to the rewrite command signal from the control means 38 and simultaneously stores the new detection signals one by one in place of the old detection signals.

The moving mean calculating means 41 has mean value operating means and calculates the mean value from the detection signals stored in the first memory means 39 in response to the calculation start command signal from the control means 38. For example, if three detection signals have been stored, the sum of three detection signals is divided by 3 to obtain the mean value. In this case, since the old detection signals are sequentially replaced by the new detection signals in the first memory means 39, the moving mean is substantially calculated by the moving mean calculating means 41.

The second memory means 40 classifies the processing data from the moving mean calculating means 41 for every analog sensor 10 and also stores a plurality of processed data with respect to one analog sensor 10. For instance, in case of calculating the simple mean from six processed pieces of data, the second memory means 40 stores six processed pieces of data for every analog sensor 10. On the other hand, upon completion of the calculating process of the simple mean, the second memory means 40 erases the processed data stored so far in response to the rewrite command signal from the control means 38, thereby preparing for reception of the processed data from the moving mean calculating means 41 in order to calculate the next simple mean.

The simple mean calculating means 42 has mean value operating means and calculates the mean value from the processed data stored in the second memory means 40 in response to the calculation start command signal from the control means 38 and derives the new processed data. This new processed data is outputted to the memory section 22 and level discriminating level 24 in FIG. 1. For instance, in case of calculating the simple mean from the six processed pieces of data obtained by the moving mean calculating means 41, the control means 38 outputs the calculation start command signal to the simple mean calculating means 42 when the six processed pieces of data were stored into the second memory means 40. The means 42 obtains the sum of six processed pieces of data and divides the sum by six to obtain the new processed data and then outputs the result to the memory section 22 and level discriminating section 24.

The operation of this system will then be explained with respect to the analog sensor 10*a*, as an example, which outputs such detection signals $d_1, d_2, d_3, \ldots, d_n$ as shown in FIG. 3.

Figures 3A, 3B, 3C:
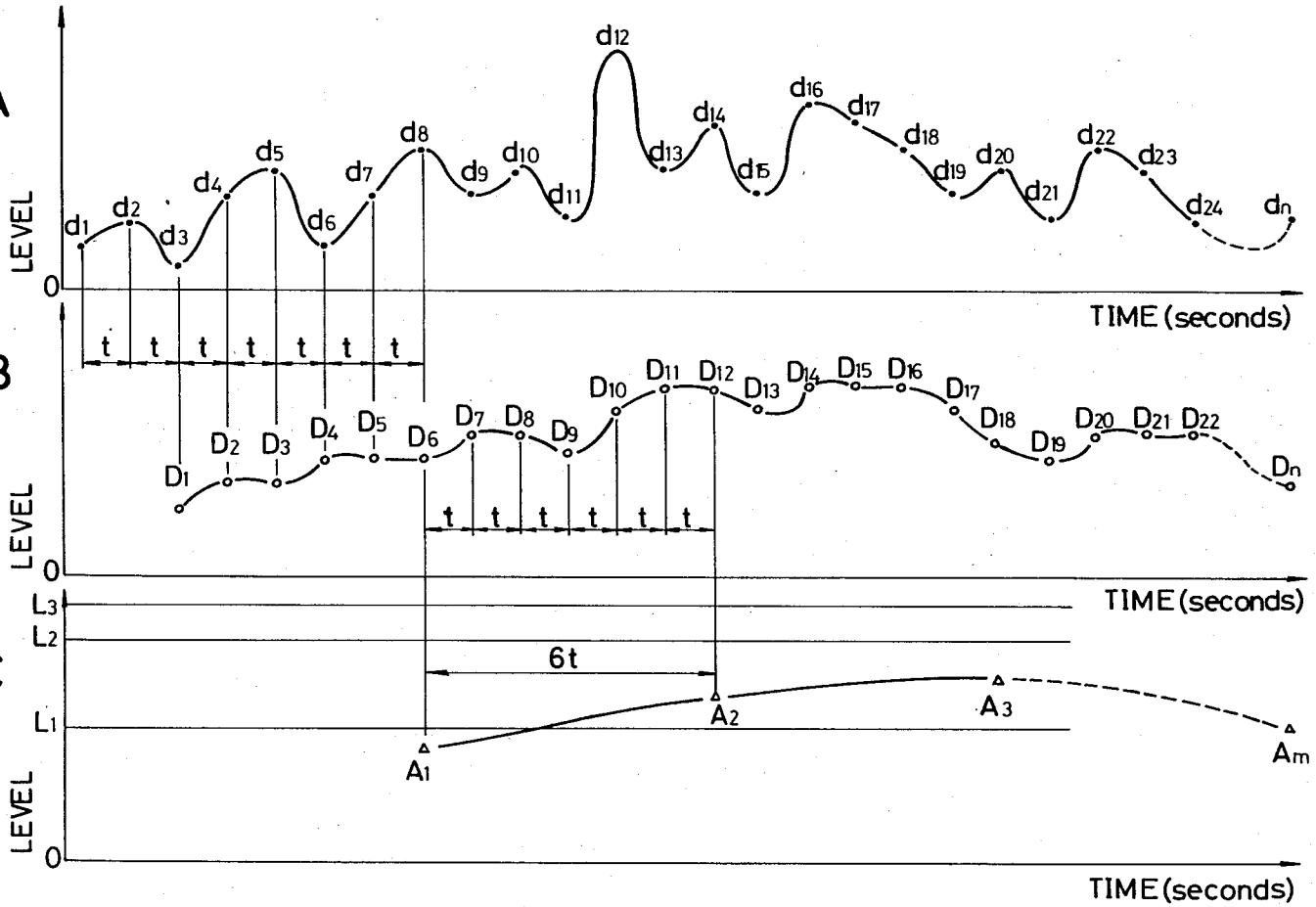
FIG. 3A is a time chart showing a time-dependent change of the analog detection signal.
FIG. 3B is a time chart showing a time-dependent change of the moving mean data derived from the analog sampling data.
FIG. 3C is a time chart showing a time-dependent change of the simple mean data derived from the moving mean data.

In FIG. 1, the receiving section 18 collects the detection signals from a plurality of analog sensors 10*a*, 10*b*, . . . , 10*n* every t seconds by way of the polling method and A/D converts these detection signals and outputs the result to the data processing section 20. The data processing section 20 classifies the detection signals from the receiving section 18 for every analog sensor and processes the data to obtain processed data $A_1, A_2, A_3, \ldots, A_m$. For instance, as shown in FIG. 3A, in the case where the detection signals $d_1$ to $d_n$ from the analog sensor 10*a* are inputted, the moving mean values $D_1, D_2, D_3, \ldots, D_n$ are first calculated whenever three detection signals are obtained as shown in FIG. 3B. Namely, $$D_1 = (d_1 + d_2 + d_3)/3$$

$$D_2 = (d_2 + d_3 + d_4)/3$$

$$D_3 = (d_3 + d_4 + d_5)/3$$

.

.

.

$$D_n = (d_n + d_{n+1} + d_{n+2})/3$$

Furthermore, as shown in FIG. 3C, whenever six moving mean values are derived, the simple mean values (processing data) $A_1, A_2, A_3, \ldots, A_m$ are sequentially calculated. That is, $$A_1 = (D_1 + D_2 + D_3 + D_4 + D_5 + D_6)/6$$

$$A_2 = (D_7 + D_8 + D_9 + D_{10} + D_{11} + D_{12})/6$$

$$A_3 = (D_{13} + D_{14} + D_{15} + D_{16} + D_{17} + D_{18})/6$$

.

.

.

$$A_m = (D_{6m-5} + D_{6m-4} + \ldots + D_{6m})/6$$

The processing data $A_1$ to $A_m$ are outputted to the memory section 22 and level discriminating section 24. The fire level $L_2$ and operation start level $L_1$ as shown in FIG. 3C are set in the level determines that a section 24. The section 24 discriminates fire has occurred in the case where a rapid change in circumstances occurs and also determines the start of the predicting calculation. Practically speaking, when it is determined that the value of the processing data from the data processing section 20 exceeds the operation start level $L_1$, a start of the predicting calculational signal is fed to the primary operating section 28. The primary operating section 28 is made operative in response to the command from the level discriminating section 24 and takes out a plurality of processed data of the analog sensor 10*a* stored in the memory section 22. The primary operating section 28 then obtains the linear function equation from this data by way of the differential value calculating method, thereby performing the predicting calculation of the fire.

First, the gradient is derived as the first predicting calculation from the linear function equation. When this gradient is positive and is also over a predetermined value, the prealarm $P_s$ is outputted to the alarm section 34 and further the second predicting calculation is carried out in the primary operating section 28. Namely, the time interval (degree of danger $R_s$) until the processing data becomes the dangerous level $L_3$ shown in FIG. 3C is calculated from the processed data at the present time and linear function equation. When the value of the degree of danger $R_s$ is 600 seconds or less, the fire signal is immediately outputted to the alarm section 34 and a fire alarm is generated without performing the predicting calculation by way of the function approximation method.

On the contrary, when $$600 < R_s \leqq 1200,$$

the uncertain signal is outputted to the approximate expression transforming section 30 and the start of the predicting calculation due to the function approximation method is instructed. The degree of danger operating section 32 calculates the degree of danger $R_f$ on the basis of the approximate equation converted by the transforming section 30. When the value of the degree of danger $R_f$ is 800 or less, the operating section 32 determines the occurrence of a fire and outputs the fire signal to the alarm section 34, thereby allowing a fire alarm to be generated.

In the foregoing embodiment of the present invention, a plurality of detection signals from the analog sensor sampled at every predetermined time are processed as one group and the moving mean of this group is calculated by the data processing section. At the same time, a plurality of these moving mean values are processed as one group and the simple mean of this group is calculated. Due to this, it is possible to eliminate the influence of the abnormal detection signals which are generated due to factors of erroneous operation such as temporary noise, tobacco smoke or factors other than an actual fire. Simultaneously, it is possible to sufficiently grasp the tendency of the change of the detection signals without causing the analog value of the smoke, temperature, gas or the like to be influenced by the oscillating frequency of the flame, shape of the room or the like. Therefore, the fire can be easily predicted and determined.

In addition, in the foregoing embodiment, the moving mean of three sampling data and the simple mean of six moving mean data are calculated. However, the number of data which are used for the mean value calculation may be arbitrarily set.

Furthermore, in the foregoing embodiment, the simple mean is further calculated from the detection signals derived by the moving mean calculation. However, the unnecessary signal component can be also removed by another embodiment in which only the moving mean is derived and the linear or higher-order predicting calculation is directly executed from this moving mean data. With this method, the number of steps of the mean value calculations can be reduced and thereby enabling the processing speed to be made faster.

In addition, although the moving mean and simple mean calculating processes are executed in the receiver in the foregoing embodiment, the analog sensor 10 itself may be provided with the moving mean calculating means and simple mean calculating means, and the moving mean processed data or simple mean processed data may be transmitted to the receiver upon sampling. This arrangement can be easily realized by providing the data processing section 20 shown in FIG. 2 in the analog sensor 10. With such an arrangement, the operation processed by the receiver is simplified and also the memory capacity for storage of the processed data in the receiver can be also reduced.

On one hand, although the fire prediction and determination are performed on the basis of the time interval until the processing data value becomes a dangerous level in the foregoing embodiment, it may be determined by checking whether or not the processing data value becomes a dangerous level after an expiration of a predetermined time.

Figure 4:
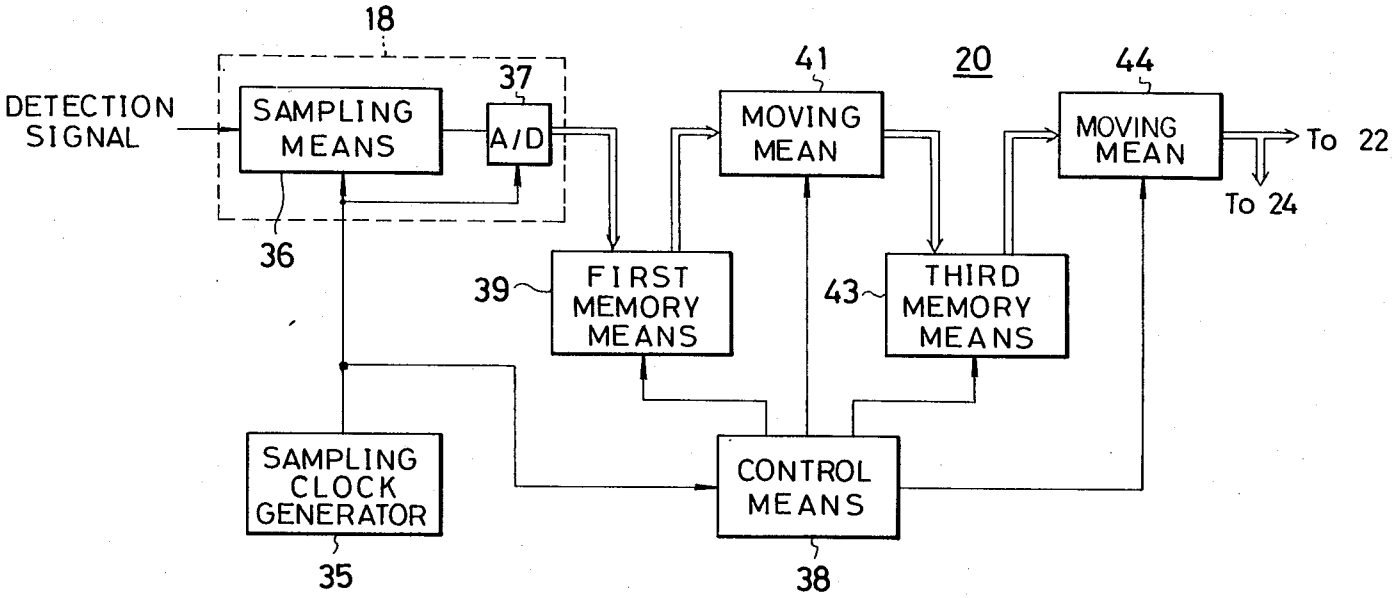
FIG. 4 is a block diagram showing another embodiment of the receiving section and data processing section in the embodiment of FIG. 1.

FIG. 4 is a block diagram showing another embodiment of the receiving section 18 and data processing section 20 shown in FIG. 1.

The embodiment of FIG. 4 is substantially similarly to the first embodiment shown in FIG. 2 except that the second memory means 40 in the embodiment of FIG. 2 is replaced by third memory means 43 and the simple mean calculating means 42 is replaced by moving mean calculating means 44.

Practically speaking, the detection signals from the analog sensor 10 are converted to the processed data for the fire discrimination by performing the process by the moving mean calculating means twice in place of the processes by way of the moving mean calculating means 41 and simple mean calculating means 42 in the embodiment of FIG. 2.

By arranging the two stages of the moving mean calculating means in this way, the influence on the detection signals due to temporary noise or the like can be eliminated. At the same time, the tendency of the change of the detection signals can be accurately grasped without causing the analog values of the smoke, temperature, gas, or the like to be influenced by the oscillating frequency of the flame, shape of the room or the like.

What is claimed is:

1. A fire alarm system comprising:

a detecting section for detecting and outputting an analog value corresponding to a change in a physical phenomenon of the ambient circumstances;

sampling means for sampling at a predetermined period the analog detection signal outputted from said detecting section;

data processing means for sequentially storing sampled data from said sampling means and for performing an averaging process of a plurality of said data stored as one group; and an alarm means for discriminating a fire on the basis of averaged data from said data processing means and then generating a fire alarm.

2. A fire alarm system according to claim 1, wherein said data processing means has:

first memory means for sequentially storing a plurality of said sampled data; and moving mean calculating means for calculating a moving mean of a plurality of said data stored as one group in said first memory means.

3. A fire alarm system according to claim 1, wherein said data processing means has:

first memory means for storing a plurality of said sampled data;

moving mean calculating means for calculating a moving mean of a plurality of said data stored as one group in said first memory means;

second memory means for storing a plurality of moving means for said moving mean calculating means; and simple mean calculating means for calculating a simple mean of said plurality of moving means stored as one group in said second memory means.

4. A fire alarm system according to claim 1, wherein said data processing means has:

first memory means for storing a plurality of said sampled data;

moving mean calculating means for calculating a moving mean of a plurality of said data stored as one group in said first memory means;

second memory means for storing a plurality of moving means from said moving mean calculating means; and another moving mean calculating means for calculating a moving mean of a plurality of said moving means stored as one group in said second memory means.

5. A fire alarm system according to claim 1, wherein said alarm means has fire discriminating means for calculating, from the present time averaged data from said data processing means, a time interval until a value of the averaged data would reach a predetermined threshold level and thereby determining the fire when said time interval calculated lies within a predetermined time.

6. A fire alarm system according to claim 1, wherein said alarm means has a fire discriminating means for determining that a fire has occurred when a detection level exceeds a threshold level after an expiration of a predetermined time period from the commencement of the processing of data on the basis of the averaged data from said data processing means.

* * * * *